US012103060B2

(12) United States Patent
Matsui et al.

(10) Patent No.: US 12,103,060 B2
(45) Date of Patent: Oct. 1, 2024

(54) ROLLING MILL AND ROLLING METHOD FOR METAL PLATE

(71) Applicant: PRIMETALS TECHNOLOGIES JAPAN, LTD., Hiroshima (JP)

(72) Inventors: Yoichi Matsui, Hiroshima (JP); Yuta Odawara, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 0 days.

(21) Appl. No.: 17/790,047

(22) PCT Filed: Jan. 29, 2020

(86) PCT No.: PCT/JP2020/003115
§ 371 (c)(1),
(2) Date: Jun. 29, 2022

(87) PCT Pub. No.: WO2021/152716
PCT Pub. Date: Aug. 5, 2021

(65) Prior Publication Data
US 2023/0107171 A1 Apr. 6, 2023

(51) Int. Cl.
*B21B 37/32* (2006.01)
*B21B 27/02* (2006.01)
(Continued)

(52) U.S. Cl.
CPC ..... *B21B 37/32* (2013.01); *B21B 27/021* (2013.01); *B21B 27/106* (2013.01); *B21B 31/18* (2013.01);
(Continued)

(58) Field of Classification Search
CPC . B21B 2027/022; B21B 27/10; B21B 27/106; B21B 37/165; B21B 37/18;
(Continued)

(56) References Cited

U.S. PATENT DOCUMENTS 2,732,591 A * 1/1956 Whittum ..... B21B 27/02 72/701
3,318,127 A * 5/1967 Astleford, Jr. ..... B21D 26/14 336/182
(Continued)

FOREIGN PATENT DOCUMENTS

EP 1 336 437 A1 8/2003
EP 2 656 933 A1 10/2013
(Continued)

OTHER PUBLICATIONS

GB 2306362A, Grocock May 1997.*
(Continued)

*Primary Examiner* — Edward T Tolan
(74) *Attorney, Agent, or Firm* — BIRCH, STEWART, KOLASCH & BIRCH, LLP

(57) ABSTRACT

A rolling mill is provided with: a roll for rolling a metal plate, the roll being capable of shifting in an axial direction and having a tapered portion at an end portion in the axial direction; and a heating unit configured to form an expansion portion protruding in a radial direction in the tapered portion by heating the tapered portion.

14 Claims, 8 Drawing Sheets

(51) Int. Cl.

| | |
|---|---|
| ***B21B 27/10*** | (2006.01) |
| ***B21B 31/18*** | (2006.01) |
| ***B21B 37/16*** | (2006.01) |
| ***B21B 38/04*** | (2006.01) |

(52) U.S. Cl.
CPC ..... *B21B 37/165* (2013.01); *B21B 38/04* (2013.01); *B21B 2027/022* (2013.01); *B21B 2261/04* (2013.01); *B21B 2269/14* (2013.01)

(58) Field of Classification Search
CPC ..... B21B 37/32; B21B 38/04; B21B 2261/04; B21B 27/021; B21B 13/142; B21B 31/18; B21B 2269/14; H05B 6/145
See application file for complete search history.

(56) References Cited

U.S. PATENT DOCUMENTS

| | | | | | |
|---|---|---|---|---|---|
| 4,750,343 | A * | 6/1988 | Richter | B21B 37/32 | 72/236 |
| 5,101,086 | A * | 3/1992 | Dion | H05B 6/145 | 219/677 |
| 6,014,881 | A * | 1/2000 | Imanari | B21B 37/32 | 72/201 |
| 8,166,785 | B2 * | 5/2012 | Ootsuka | B21B 37/32 | 72/224 |
| 2007/0193322 | A1 * | 8/2007 | Beck | B21B 37/44 | 72/11.7 |
| 2009/0235715 | A1 * | 9/2009 | Werz | B21D 53/20 | 72/342.1 |
| 2010/0200570 | A1 * | 8/2010 | Chirico | D21G 1/0053 | 219/619 |

FOREIGN PATENT DOCUMENTS

| | | | | | |
|---|---|---|---|---|---|
| GB | 2080719 | A * | 2/1982 | B21B 37/32 | |
| JP | 60-170508 | A | 9/1985 | | |
| JP | 4-367308 | A | 12/1992 | | |
| JP | 2013-226573 | A | 11/2013 | | |
| JP | 6152837 | B2 | 6/2017 | | |

OTHER PUBLICATIONS

JP 63-5801A, Onoda Jan. 1988.*
CN 110355210A, Luo et al. Oct. 2019.*
AT 407497 B, Mayrhofer et al. Mar. 2001.*
JP 2000-225406A, Aoi et al. Aug. 2000.*
JP 03-297507A, Nakano et al. Dec. 1991.*
JP 63-171209A, Yamamoto Jul. 1998.*
EP 2656933A1, Norikura Oct. 2013.*
KR 100856276B1, Her et al. Sep. 2008.*
Office Action dated Oct. 4, 2022 issued in counterpart Japanese Application No. 2021-573682 with an English Machine Translation.
International Search Report for PCT/JP2020/003115 mailed on Feb. 25, 2020.
Written Opinion of the International Searching Authority for PCT/JP2020/003115 mailed on Feb. 25, 2020.
Extended European Search Report dated Dec. 7, 2022 issued to the corresponding European Application No. 20916644.6.

* cited by examiner

ROLLING MILL AND ROLLING METHOD FOR METAL PLATE

TECHNICAL FIELD

The present disclosure relates to a rolling mill and a rolling method for a metal plate.

BACKGROUND

In rolling a metal plate with a rolling mill, a phenomenon that the plate thickness becomes thinner at a plate width edge portion than at other portions, i.e., so-called edge drop, may occur depending on rolling conditions. Since the edge drop may lead to a decrease in yield, some measures have been taken to reduce the edge drop.

For example, Patent Document 1 describes that a tapered portion is provided at an end portion of a work roll of a rolling mill, and the work roll is shifted in the axial direction such that a widthwise edge portion of a rolled material is positioned at the tapered portion under rolling to reduce the edge drop. Further, Patent Document 1 describes that the edge drop or the like is reduced by heating or cooling the widthwise edge portion of the rolled material in order to flatten the cross-sectional profile of the rolled material.

Patent Document 2 does not aim to reduce the edge drop, but Patent Document 2 describes that an expansion portion is formed by heating a region of an end portion of the work roll in contact with an edge portion of a steel plate (rolled material) to increase the rolling reduction of the edge portion of the steel plate under cold rolling, thereby reducing edge cracks.

CITATION LIST

Patent Literature

Patent Document 1: JPS60-170508A
Patent Document 2: JP6152837B

SUMMARY

Problems to be Solved

When the shift amount in the axial direction of the work roll having a tapered portion at the axial end portion is increased, an axial range (or a plate widthwise range) in which a gap between the rolls can be adjusted increases, so that the edge drop may be controlled more precisely. On the other hand, when the shift amount of the work roll is increased, a phenomenon (edge up) is likely to occur that the plate thickness is locally increased at an axial position where the gap between the rolls is large. In this case, the tension in the rolling direction (the traveling direction of the rolled material) may change sharply at the plate widthwise edge portion (edge tight), which may cause the plate breakage.

In this regard, in the rolling mill described in Patent Document 1, since reducing the edge up or the plate breakage due to edge tight is not taken into consideration, it is difficult to increase the shift amount of the work roll. Therefore, the effect of reducing the edge drop is limited. Further, in the rolling mill described in Patent Document 2, the expansion portion at the end of the work roll can reduce the occurrence of edge cracks in the rolled material, but on the other hand may promote the occurrence of edge drop.

In view of the above, an object of at least one embodiment of the present invention is to provide a rolling mill and a rolling method for a metal plate whereby it is possible to effectively reduce the edge drop.

Solution to the Problems

A rolling mill according to at least one embodiment of the present invention is provided with: a roll for rolling a metal plate, the roll being capable of shifting in the axial direction and having a tapered portion at an end portion in the axial direction; and a heating unit configured to form an expansion portion protruding in the radial direction in the tapered portion by heating the tapered portion.

Advantageous Effects

At least one embodiment of the present invention provides a rolling mill and a rolling method for a metal plate whereby it is possible to effectively reduce the edge drop.

DETAILED DESCRIPTION

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

Figure 1:
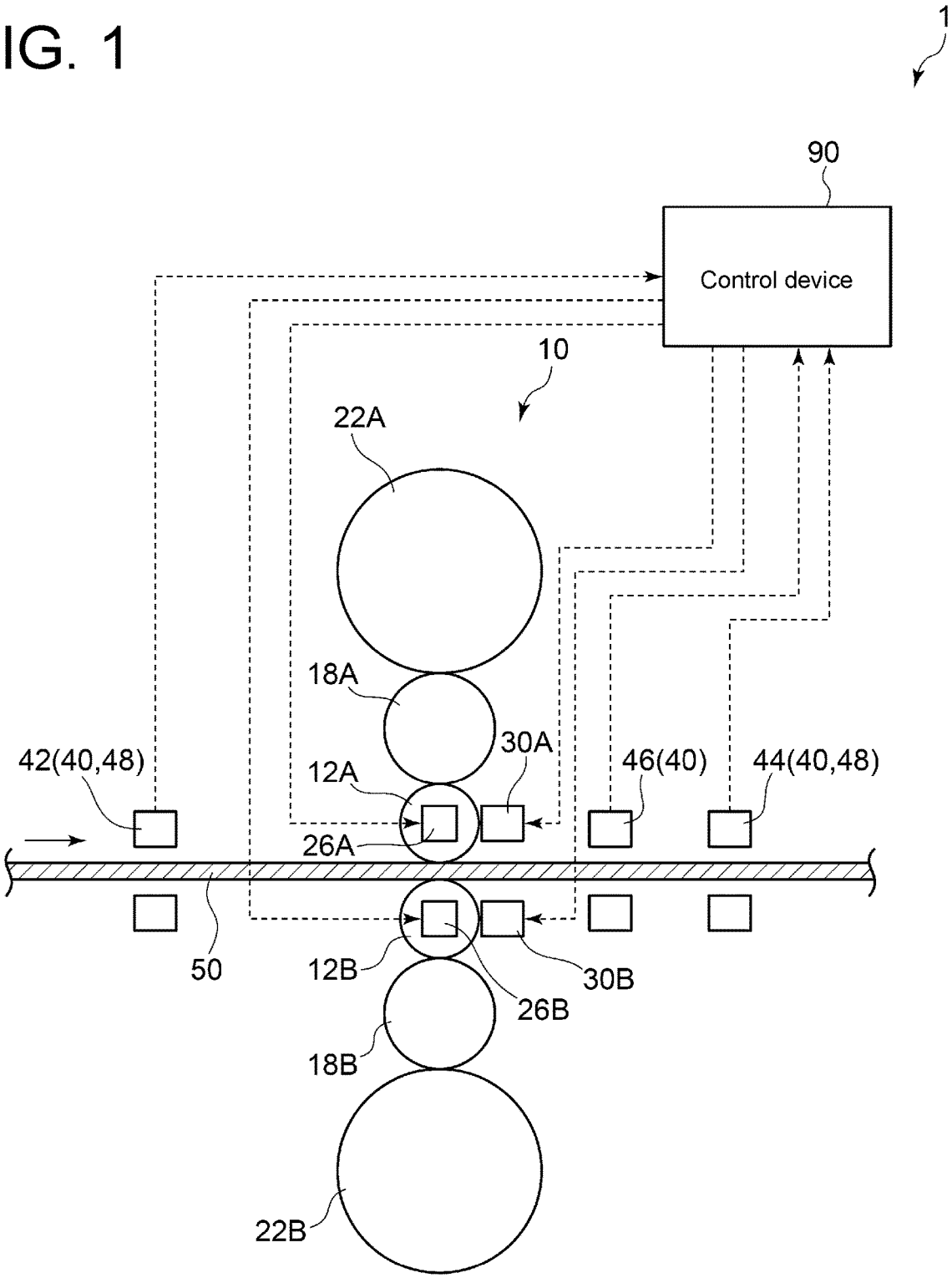
FIG. 1 is a schematic configuration diagram of a rolling mill according to an embodiment.
Figure 2:
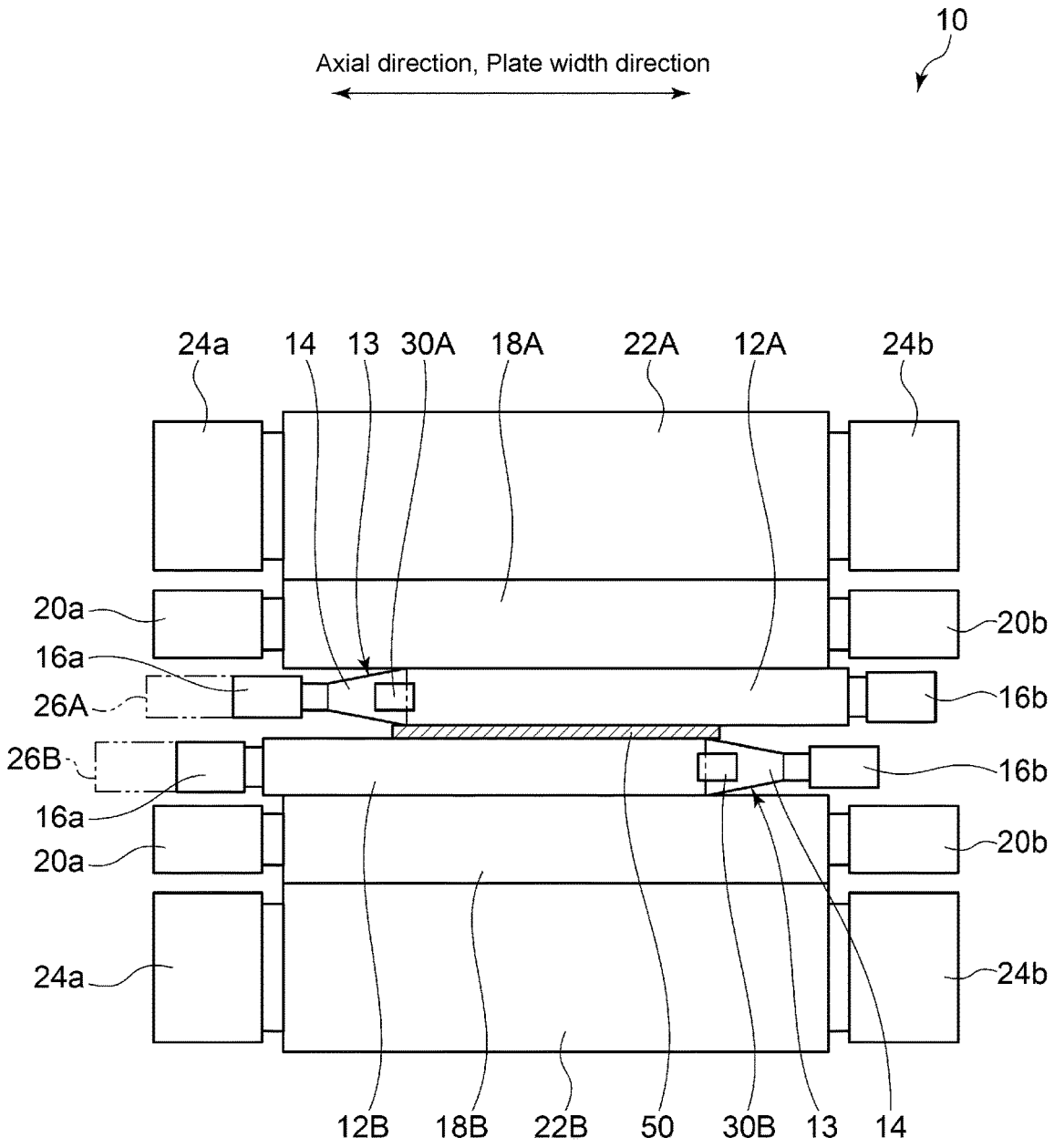
FIG. 2 is a diagram of rolling stands shown in FIG. 1, when viewed in a traveling direction of a metal plate.
Figure 3:
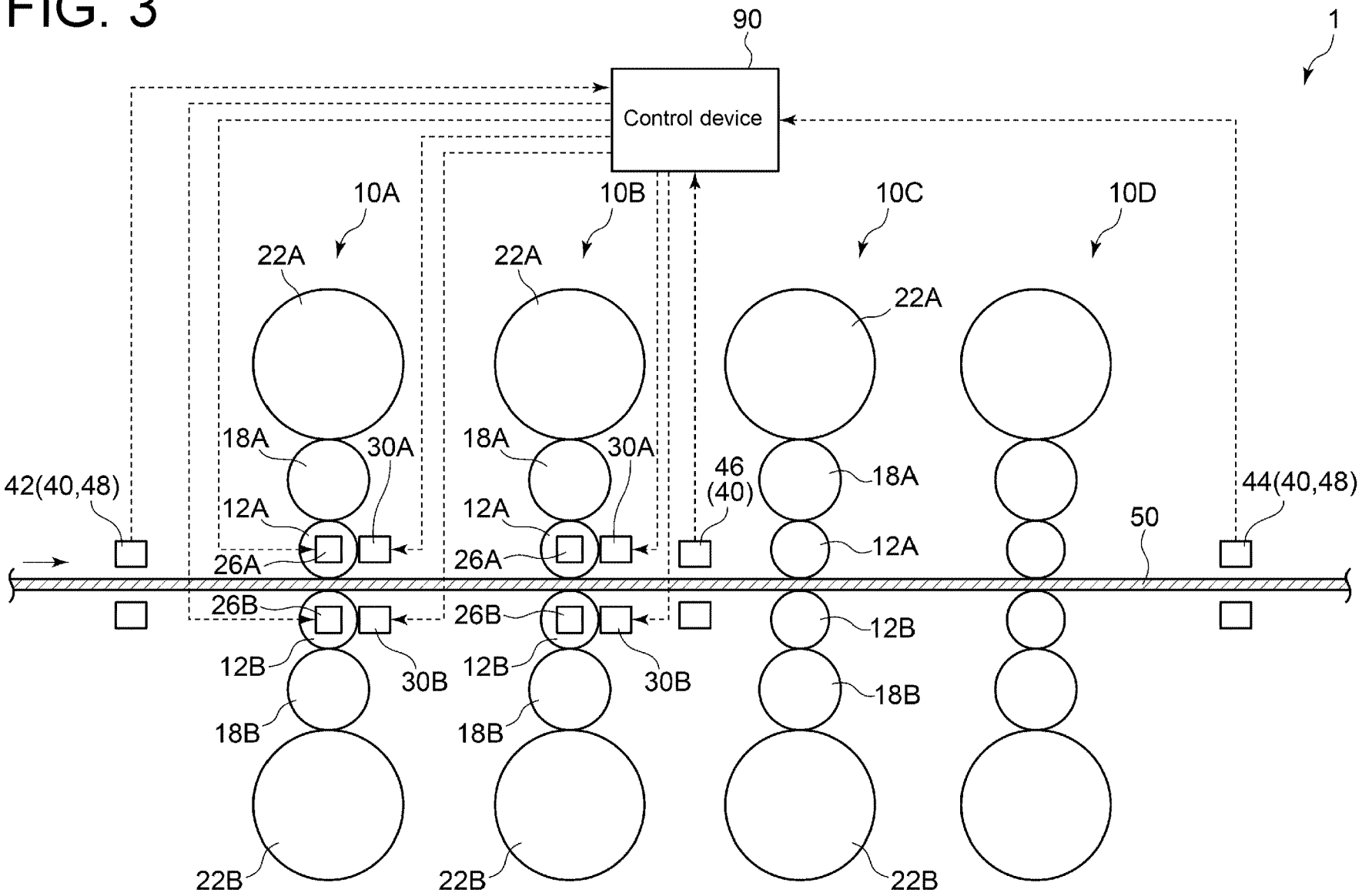
FIG. 3 is a schematic configuration diagram of a rolling mill according to an embodiment.
Figure 4:
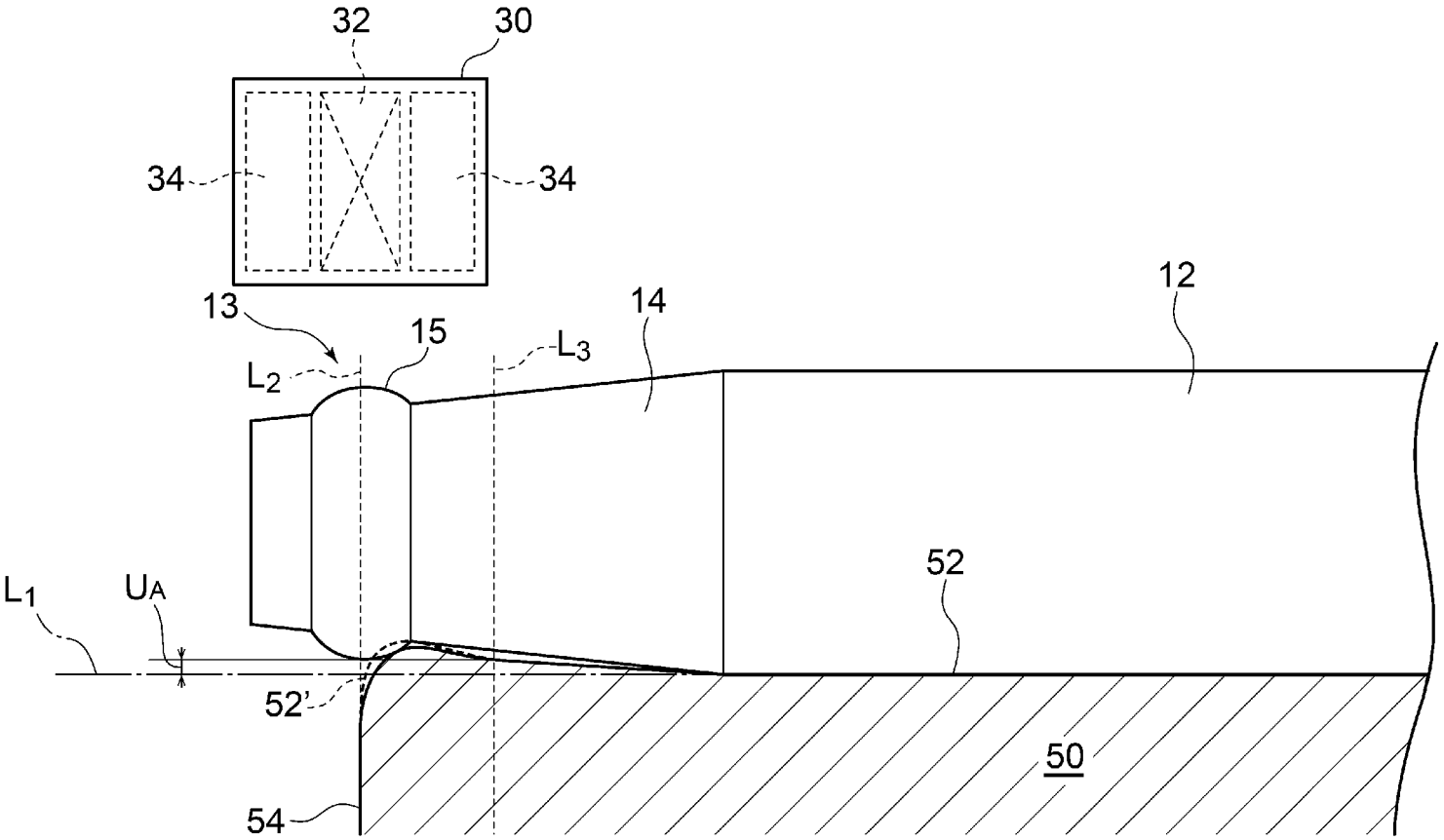
FIG. 4 is a schematic diagram showing the vicinity of an end portion of a work roll of a rolling mill according to an embodiment.
Figure 5:
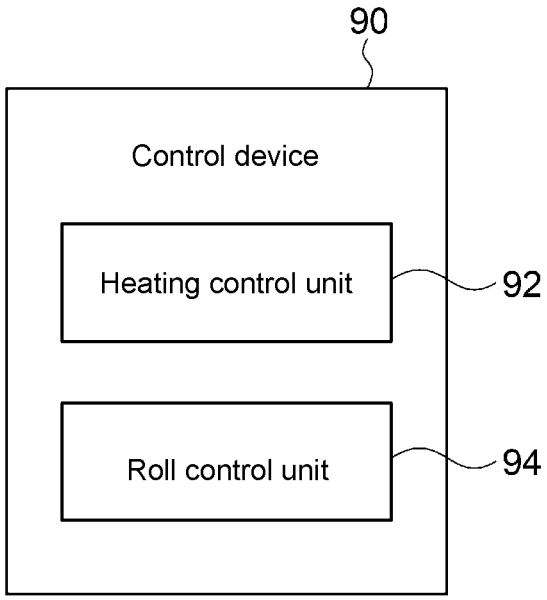
FIG. 5 is a schematic configuration diagram of a control device of a rolling mill according to an embodiment.

FIGS. 1 and 3 are each a schematic configuration diagram of a rolling mill according to an embodiment. FIG. 2 is a diagram of rolling stands shown in FIG. 1, when viewed from downstream to upstream in a traveling direction of a metal plate. FIG. 4 is a schematic diagram showing the vicinity of an end portion of a work roll of a rolling mill according to an embodiment. FIG. 5 is a schematic configuration diagram of a control device of a rolling mill according to an embodiment.

As shown in FIGS. 1 and 3, a rolling mill 1 includes at least one rolling stand 10. The rolling stand 10 includes a pair of work rolls 12A and 12B provided so as to sandwich a metal plate 50 which is a rolled material, a pair of intermediate rolls 18A and 18B, and a pair of backup rolls 22A and 22B. Additionally, the rolling stand 10 includes a rolling reduction device (such as a hydraulic cylinder; not shown) for reducing the thickness of the metal plate 50 by applying a load to the pair of work rolls 12A, 12B.

As shown in FIG. 2, the pair of work rolls 12A, 12B are rotatably supported by bearings (not shown) housed in bearing boxes 16*a*, 16*b*, respectively. The pair of intermediate rolls 18A, 18B are rotatably supported by bearings (not shown) housed in bearing boxes 20*a*, 20*b*, respectively. The pair of backup rolls 22A, 22B are rotatably supported by bearings (not shown) housed in bearing boxes 24*a*, 24*b*, respectively. The intermediate rolls 18A, 18B and the backup rolls 22A, 22B are configured to support the work rolls 12A, 12B.

A motor (not shown) is connected to the work rolls 12A, 12B via, for example, a spindle (not shown), and the work rolls 12A, 12B are rotationally driven by the motor. In rolling of the metal plate 50, the work rolls 12A, 12B are rotated by the motor while the metal plate 50 is pressed by the rolling reduction device, which creates a frictional force between the work rolls 12A, 12B and the metal plate 50. With this friction force, the metal plate 50 is moved to the exit side of the work rolls 12A, 12B.

As shown in FIG. 3, the rolling mill 1 may include a plurality of rolling stands 10. In the exemplary embodiment shown in FIG. 3, the rolling mill 1 includes a plurality of rolling stands 10A to 10D arranged at intervals along the traveling direction of the metal plate 50. In the rolling mill 1, the metal plate 50 is sequentially rolled by the rolling stands 10A to 10D.

The work roll 12A, 12B according to some embodiments is configured to be shiftable in the axial direction. In some embodiments, the rolling mill 1 includes a roll driving unit 26 configured to shift the work roll 12A, 12B in the axial direction. In the exemplary embodiments shown in FIGS. 1 to 3, shift cylinders are provided for the work rolls 12A, 12B as roll driving units 26A, 26B, respectively, and the work rolls 12A, 12B can be moved along the axial direction by driving the shift cylinders.

As shown in FIG. 2, the work roll 12A, 12B according to some embodiments has a tapered portion 14 disposed at an end portion 13 in the axial direction. The tapered portion 14 has a shape that tapers to the axial end of the work roll 12A, 12B. In some embodiments, as shown in FIG. 2, of the pair of work rolls 12A, 12B, one work roll 12A may have the tapered portion 14 at one end, and the other work roll 12B may have the tapered portion 14 at the opposite end. Alternatively, in some embodiments, the pair of work rolls 12A, 12B may have the tapered portions 14 at both ends.

In some embodiments, the rolling stand 10 is provided with a heating unit 30 (30A, 30B) for heating the tapered portion 14. The heating unit 30 is configured to form an expansion portion 15 (see FIG. 4) protruding in the radial direction in the tapered portion 14 of the work roll 12 (12A, 12B).

FIG. 4 is a schematic diagram showing the positional relationship between the work roll 12, the heating unit 30, and the metal plate 50 in the axial direction of the work roll 12 and is not a view of the rolling stand 10 as viewed from a specific direction. However, for the metal plate 50, a cross-section orthogonal to the traveling direction of the metal plate 50 is shown.

The heating unit 30 is installed in the vicinity of the tapered portion 14 and is configured to heat a partial region of the tapered portion 14 in the axial direction. When the work roll 12 rotates, the above-described region of the tapered portion 14 is heated circumferentially by the heating unit 30, so that a circumferential expansion portion 15 that protrudes in the radial direction is formed due to the thermal expansion of the work roll 12 in this region.

In FIGS. 1 to 3, the heating unit 30 is disposed downstream of the work roll 12 in the traveling direction of the metal plate 50, but in some embodiments, the heating unit 30 may be disposed upstream of the work roll 12.

Here, in FIG. 4, the reference numeral 52' indicates the shape of the surface of the metal plate 50 when it is assumed that the work roll 12 is rolled in a state where the expansion portion 15 is not formed in the tapered portion 14. Further, in FIG. 4, the straight line L1 indicates the position of the surface 52 at a specified position in the plate width central portion of the metal plate 50, the straight line L2 indicates the position of the plate edge 54 of the metal plate 50 in the plate width direction, and the straight line L3 indicates a measurement position (position of the plate edge portion) of the edge drop amount or the edge up amount in the plate width direction (the same applies to FIG. 6 described later).

The edge drop amount or edge up amount of the metal plate 50 can be calculated as a difference between the plate thickness at the specified position in the plate width central portion of the metal plate 50 and the plate thickness at the measurement position. The specified position and the measurement position can be defined as, for example, positions at a specified distance from the plate edge 54. For example, the specified position may be a position 115 mm away from the plate edge 54 in the plate width direction, and the measurement position may be a position 15 mm away from the plate edge 54 in the plate width direction.

It is conventionally known that a work roll having a tapered portion at an axial end portion is shifted in the axial direction such that a widthwise edge portion of a rolled material is positioned at the tapered portion under rolling to reduce the edge drop. When the shift amount of the work roll having a tapered portion in the axial direction is increased, an axial range (or a plate widthwise range) in which a gap between the pair of work rolls 12 (roll-to-roll gap) can be adjusted increases, so that the edge drop may be controlled more precisely. On the other hand, when the shift amount of the work roll is increased in order to achieve a target edge up amount UA (see FIG. 4), for example, as indicated by the reference numeral 52' in FIG. 4, the plate thickness tends to locally increase at an axial position where the gap between the rolls is large. In this case, the tension in the rolling direction (the traveling direction of the metal plate 50) may change sharply at the plate widthwise edge portion (edge tight), which may cause the plate breakage.

In contrast, with the rolling mill 1 according to the above-described embodiment, since the expansion portion 15 protruding in the radial direction is formed by the heating unit 30 in the tapered portion 14 disposed at the end portion 13 of the work roll 12, as shown in FIG. 4, the surface shape of the metal plate 50 has a shape indicated by the reference numeral 52, and the expansion portion 15 suppresses a local increase in the plate thickness of the edge portion 13 of the metal plate 50 in the plate width direction. As a result, a sharp change in tension (edge tight) at the edge portion 13 of the metal plate 50 can be suppressed, and the plate breakage at the edge portion 13 can be reduced, so that the shift amount of the work roll 12 can be increased, and the edge up amount can be brought closer to the target value UA.

Consequently, the edge drop which may occur in rolling of the metal plate 50 can be appropriately controlled and effectively reduced, and the yield can be improved.

In some embodiments, the heating unit 30 is configured to be movable along the axial direction. In some embodiments, the rolling mill 1 includes a heating unit driving unit (not shown) configured to move the heating unit 30 along the axial direction. In this case, the heating position of the tapered portion 14 by the heating unit 30 can be changed by moving the heating unit 30 in the axial direction of the work roll 12. By adjusting the heating position appropriately, the edge tight which may occur in the metal plate 50 can be effectively suppressed.

In some embodiments, for example as shown in FIG. 4, the heating unit 30 is configured to form the expansion portion 15 inward in the plate width direction from the plate edge 54 of the metal plate 50 in the plate width direction. Herein, the direction from the plate edge 54 to the center of the metal plate 50 in the plate width direction is defined as inward in the plate width direction, and the direction from the center to the plate edge 54 of the metal plate 50 in the plate width direction is defined as outward in the plate width direction.

According to the above-described embodiment, since the expansion portion 15 is formed, in the tapered portion 14, inward of the position of the plate edge 54 (plate edge position) of the metal plate 50 in the plate width direction, the edge tight which is likely to occur inward of the plate edge 54 can be effectively suppressed. Consequently, the shift amount of the work roll 12 can be increased, and the edge drop which may occur in rolling of the metal plate 50 can be more effectively reduced.

In some embodiments, the heating unit 30 is configured to heat the tapered portion 14 by at least one of an electromagnetic induction coil, a heating medium, or a laser beam.

According to the above-described embodiment, since the tapered portion 14 can be heated by an electromagnetic induction coil, a heating medium, or a laser beam, it is easy to locally heat the tapered portion 14. Thus, the position and range forming the expansion portion 15 in the tapered portion 14 can be accurately adjusted, so that the edge tight can be effectively suppressed.

In some embodiments, for example as shown in FIG. 4, the heating unit 30 includes an electromagnetic induction coil 32 and an electromagnetic shield 34. The electromagnetic shield 34 is configured to limit a magnetic path through which a magnetic flux generated by the electromagnetic induction coil 32 flows. The electromagnetic shield 34 may be composed of a grounded conductor. In the exemplary embodiment shown in FIG. 4, electromagnetic shields 34 are provided on both sides of the electromagnetic induction coil 32 in the axial direction of the work roll 12. Thereby, the magnetic path is limited in the axial direction.

According to the above-described embodiment, since the electromagnetic shield 34 is configured to limit a magnetic path through which a magnetic flux generated by the electromagnetic induction coil 32 flows, it is easy to limit the heating range of the tapered portion 14 by the electromagnetic induction coil 32. Thus, the position and range forming the expansion portion 15 in the tapered portion 14 can be more accurately adjusted, so that the edge tight can be effectively suppressed.

In the case of a tandem rolling mill 1 including a plurality of rolling stands 10 (see FIG. 3, for example), the heating unit 30 may be disposed on at least one rolling stand 10 upstream of the most downstream rolling stand 10 of the plurality of rolling stands 10. Alternatively, the heating unit 30 may be disposed on the most upstream rolling stand 10 of the plurality of rolling stands 10. In the exemplary embodiment shown in FIG. 3, of the rolling stands 10A to 10C upstream of the most downstream rolling stand 10D, the heating unit 30 is disposed on each of the rolling stand 10A and the rolling stand 10B.

The edge drop of the metal plate 50 is often a problem in cold rolling using a tandem rolling mill. In this regard, in the above-described embodiment, the work roll 12 having the tapered portion 14 and capable of shifting in the axial direction and the heating unit 30 are disposed on the upstream rolling stand 10 of the plurality of rolling stands 10. That is, since the work roll 12 and the heating unit 30 are disposed on the rolling stand 10 at a position where the temperature of the metal plate 50 is relatively high and flexible, particularly in cold rolling, the edge up can be effectively suppressed, so that the edge drop can be effectively reduced.

As shown in FIGS. 1 and 3, in some embodiments, the rolling mill 1 may be equipped with a control device 90 for controlling the rolling mill 1. As shown in FIG. 5, the control device 90 may include a heating control unit 92 for controlling the heating of the tapered portion 14 by the heating unit 30, and a roll control unit 94 for controlling the shifting of the work roll 12 in the axial direction.

The control device 90 may be configured to receive signals indicating detection results from a measuring instrument (e.g., a plate edge detection unit 40 or a plate thickness detection unit 48 described later) and perform control based on the detection results.

The control device 90 may include a processor, a memory (RAM), an auxiliary storage part, and an interface. The control device 90 receives signals from the above-described measuring instrument via the interface. The processor is configured to process the signals thus received. Further, the processor is configured to process a program loaded into the memory.

The processing contents in the control device 90 may be implemented as programs executed by the processor and may be stored in the auxiliary storage part. When the program is executed, the program is loaded into the memory. The processor reads the program from the memory and executes instructions contained in the program.

The heating control unit 92 is configured to decide the heating position of the tapered portion 14 in the axial direction by the heating unit 30, on the basis of the plate edge position of the metal plate 50 in the plate width direction. The heating control unit 92 may be configured to move the heating unit 30 so as to heat the tapered portion 14 at the heating position decided as described above.

Since the heating control unit 92 decides the heating position of the tapered portion 14 in the axial direction of the work roll 12 on the basis of the plate edge position of the metal plate 50, even when the plate edge position of the metal plate 50 changes, the heating position can be adjusted according to the plate edge position, and the edge tight can be effectively suppressed.

The heating control unit 92 may be configured to decide the heating position, on the basis of the plate edge position detected by a plate edge detection unit 40. As the plate edge detection unit 40, for example, an edge position meter, a shape meter, or an edge drop meter can be used.

The edge position meter may be configured to detect the plate edge position using radiation (e.g., X-rays or gamma rays). The use of radiation allows downsizing of the edge position meter. This makes it easy to install the edge position meter near the rolling stand 10, or when the rolling mill 1 includes a plurality of rolling stands 10, makes it easy to arrange the edge position meter between adjacent rolling stands 10.

The shape meter may be configured to measure the tension distribution of the metal plate 50 in the plate width direction. The tension of the metal plate 50 in the plate width direction is positive at a position where the metal plate 50 is present, whereas it is zero at a position where the metal plate 50 is not present. Thus, the plate edge position can be grasped from the tension distribution in the plate width direction.

The edge drop meter may be configured to measure the plate thickness distribution in a plate widthwise range including the plate edge portion. The plate thickness of the metal plate 50 in the plate width direction is positive at a position where the metal plate 50 is present, whereas it is zero at a position where the metal plate 50 is not present. Thus, the plate edge position can be grasped from the plate thickness distribution in the plate width direction. Further, the edge drop meter may be configured to detect the edge drop amount of the metal plate 50 on the basis of the plate thickness distribution.

In some embodiments, the plate edge detection unit 40 is disposed on the entry side of the work roll 12 in the traveling direction of the metal plate 50. In this case, by feed-forwarding the plate edge position detected by the plate edge detection unit 40, the heating position of the tapered portion 14 by the heating unit 30 can be appropriately controlled.

In some embodiments, the plate edge detection unit 40 is disposed on the exit side of the work roll 12 in the traveling direction of the metal plate 50. In this case, by feed-backing the plate edge position detected by the plate edge detection unit 40, the heating position of the tapered portion 14 by the heating unit 30 can be appropriately controlled.

In some embodiments, the plate edge detection unit 40 is disposed between two rolling stands 10 which are adjacent to each other in the traveling direction of the metal plate 50 among the plurality of rolling stands 10. In this case, by feed-backing or feed-forwarding the plate edge position detected by the plate edge detection unit 40, the heating position of the tapered portion 14 by the heating unit 30 can be appropriately controlled. Further, as compared with the case of detecting the plate edge position on the entry side or the exit side of the plurality of rolling stands 10, the plate edge detection position can be easily brought closer to the heating position, so that the responsiveness of control of the heating position can be easily improved.

The roll control unit 94 is configured to decide the shift amount of the work roll 12, on the basis of a parameter related to the thickness of the edge portion of the metal plate 50 in the plate width direction. For example, the roll control unit 94 may be configured to decide the shift amount of the work roll 12 on the basis of the thickness distribution at the edge portion of the metal plate 50 in the plate width direction. Alternatively, the roll control unit 94 may be configured to decide the shift amount of the work roll 12, on the basis of the edge drop amount of the metal plate 50.

The roll control unit 94 may be configured to control the roll driving unit 26 (shift cylinder) so as to move the work roll 12 by the shift amount decided as described above.

The roll control unit 94 may be configured to decide the shift amount of the work roll 12, on the basis of the parameter related to the thickness detected by a plate thickness detection unit 48. As the plate thickness detection unit 48, for example, an edge drop meter can be used.

The plate thickness detection unit 48 may be disposed on the entry side or the exit side of the work roll 12 in the traveling direction of the metal plate. In this case, by feed-forwarding or feed-backing the parameter related to the thickness detected by the plate thickness detection unit 48, the shifting of the work roll 12 can be appropriately controlled.

In the exemplary embodiment shown in FIG. 1, the rolling mill 1 includes an edge drop meter 42 disposed on the entry side of the work roll 12, an edge drop meter 44 and an edge position meter 46 disposed on the exit side of the work roll 12.

In the exemplary embodiment shown in FIG. 3, the rolling mill 1 includes an edge drop meter 42 disposed on the entry side of the plurality of rolling stands 10A to 10D, an edge drop meter 44 disposed on the exit side of the plurality of rolling stands 10A to 10D, and an edge position meter 46 disposed between the adjacent rolling stands 10B and 10C of the plurality of rolling stands 10A to 10D.

In the exemplary embodiments shown in FIGS. 1 and 3, the heating control unit 92 is configured to decide the heating position of the tapered portion 14 by the heating unit 30 on the basis of a detection result of at least one of the edge drop meter 42, the edge drop meter 44, or the edge position meter 46. Further, the roll control unit 94 is configured to decide the shift amount of the work roll 12, on the basis of a detection result of at least one of the edge drop meter 42 or the edge drop meter 44.

Figure 6:
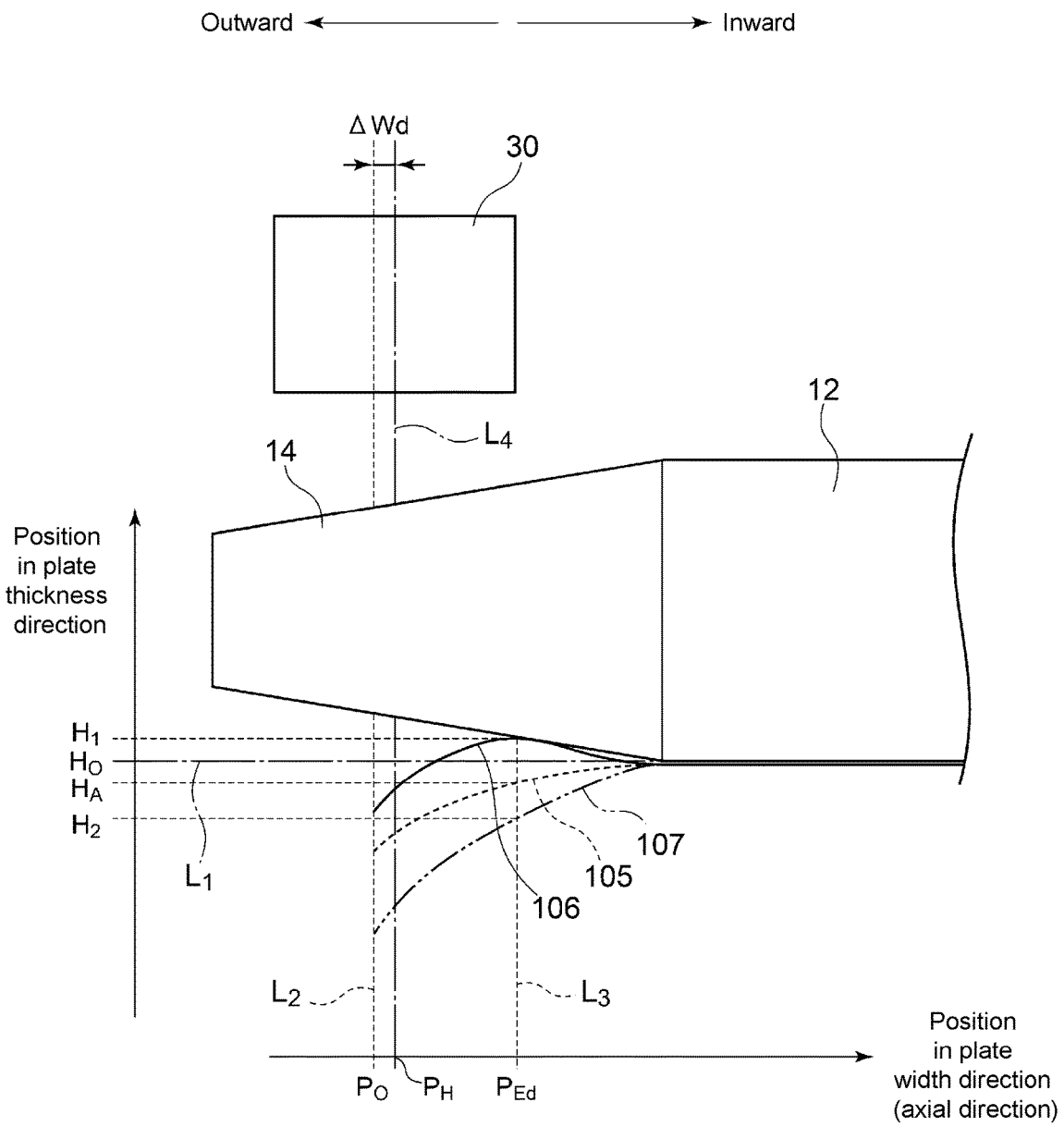
FIG. 6 is a schematic diagram for describing control of edge drop in the rolling mill according to an embodiment.
Figure 7:
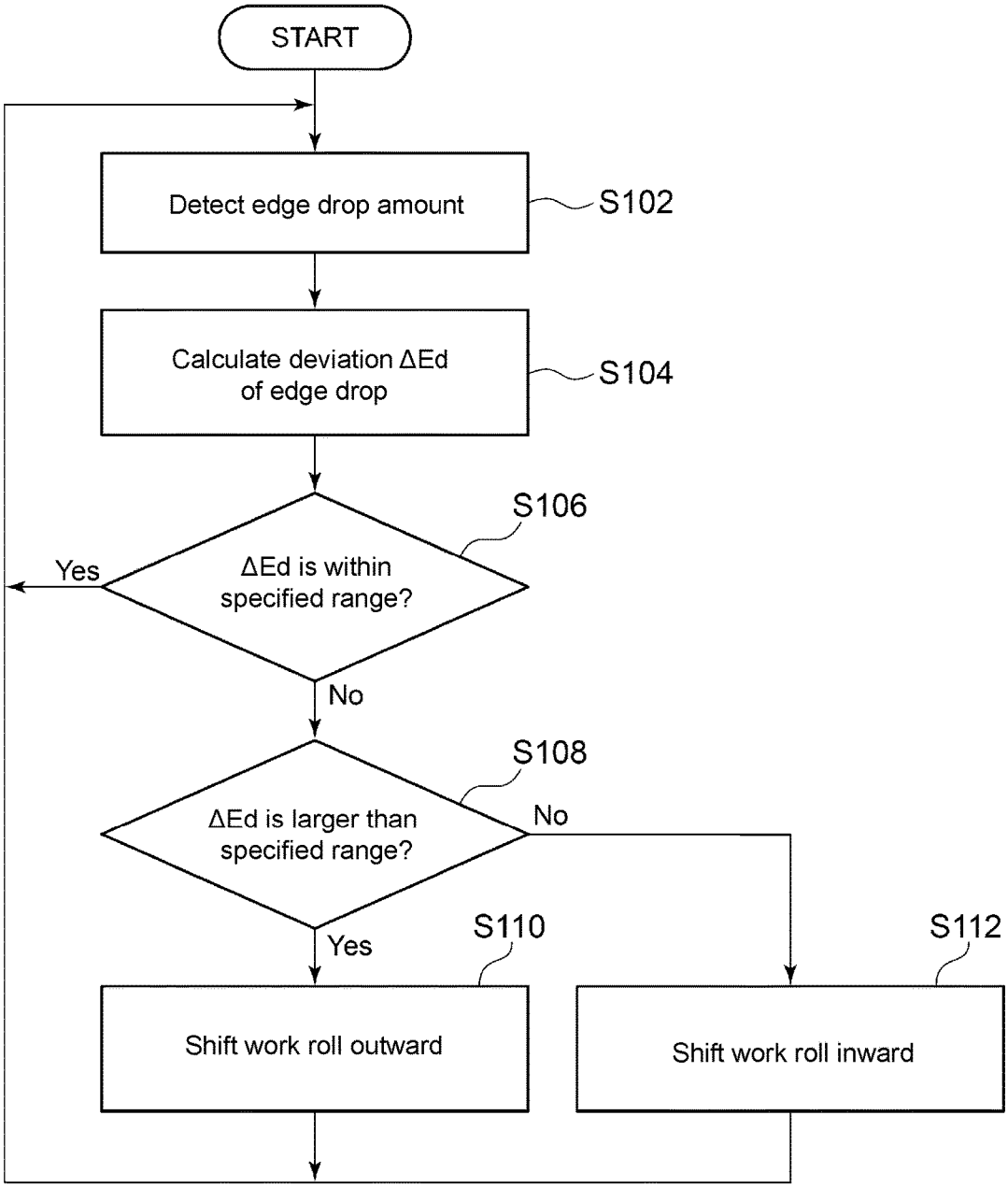
FIG. 7 is a flowchart of an example of shift control of the work roll according to an embodiment.
Figure 8:
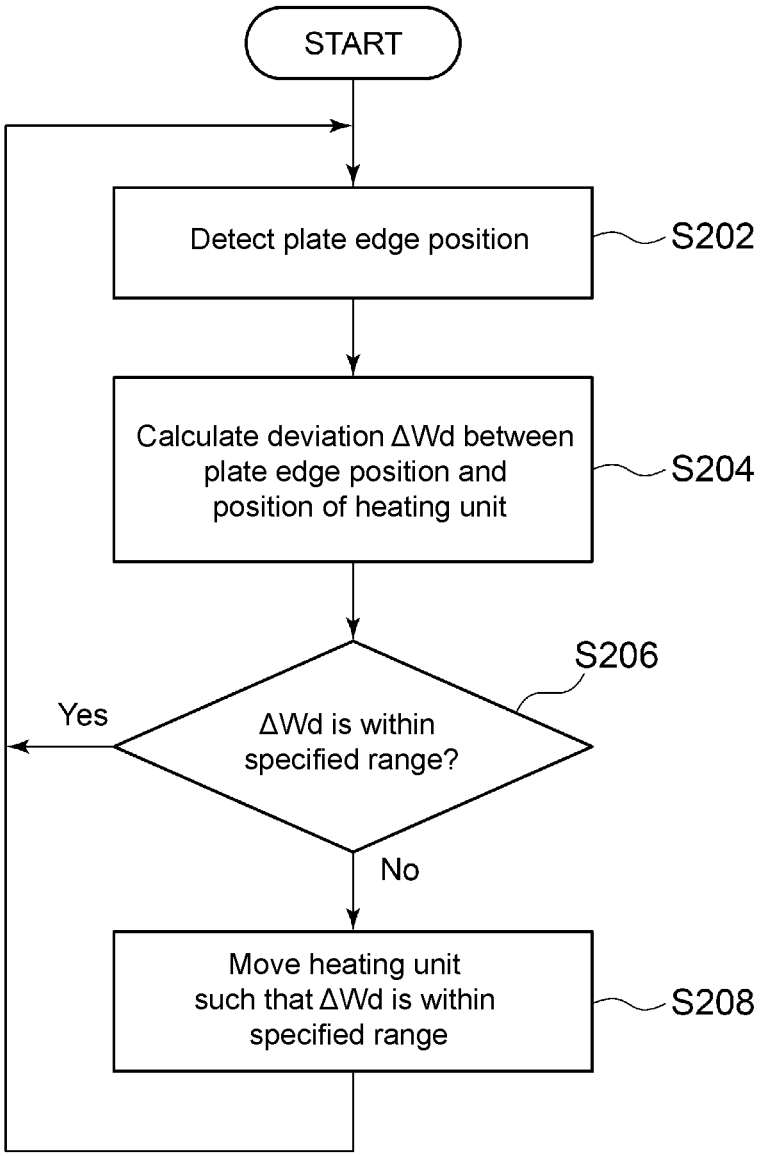
FIG. 8 is a flowchart of an example of control of the heating position by the heating unit according to an embodiment.

Next, with reference to FIGS. 6 to 8, control of edge drop in the rolling mill 1 according to some embodiments will be described. FIG. 6 is a schematic diagram for describing control of edge drop in the rolling mill according to an embodiment. FIG. 7 is a flowchart of an example of shift control of the work roll 12. FIG. 8 is a flowchart of an example of control of the heating position of the tapered portion 14 by the heating unit 30. In FIG. 6, the straight line L4 indicates the heating position of the tapered portion 14 by the heating unit 30 in the plate width direction.

In an embodiment, the shifting of the work roll 12 is controlled by the roll control unit 94 according to the flowchart shown in FIG. 7. First, the edge drop amount Ed is detected by an edge drop meter (plate thickness detection unit 48) disposed on the entry side or the exit side of the work roll 12 (step S102).

Here, the edge drop amount Ed of the metal plate 50 is a difference between the plate thickness at a specified position in the central portion of the metal plate 50 and the plate thickness at a measurement position $P_{Ed}$ (see FIG. 6) away from the plate edge ($P_0$ position in FIG. 6) of the metal plate 50 by a specified distance inward in the plate width direction. In the plate thickness direction, when the direction from the metal plate 50 to the work roll 12 is defined as a positive direction, the position coordinate of the surface of the metal plate 50 in the plate thickness direction at the specified position is $H_0$, and the position coordinate of the surface of the metal plate 50 in the plate thickness direction at the measurement position $P_{Ed}$ is H, the edge drop amount Ed is represented by $(H-H_0)$. In this description, when the edge drop amount Ed is positive, the plate thickness at the measurement position is larger than that at the central portion (edge up occurs), while when the edge drop amount Ed is negative, the plate thickness at the measurement position is smaller than that at the central portion (edge drop occurs).

Then, the edge drop deviation ΔEd, which is a deviation between the edge drop amount Ed detected in step S102 and a target value $Ed_A$ of the edge drop amount, is calculated (step S104). In FIG. 6, the curve 105 indicates an example of the surface shape of the metal plate 50 when the edge drop amount is the target value $Ed_A$. In this example, the position coordinate of the surface of the metal plate 50 at the measurement position $P_{Ed}$ is $H_A$. Since the target value $Ed_A$ of the edge drop amount is represented by $(H_A-H_0)$, the edge drop deviation $\Delta Ed=(Ed-Ed_A)=(H-H_A)$ is established.

Then, it is determined whether the edge drop deviation ΔEd calculated in step S104 is within a specified range (step S106). If the edge drop deviation ΔEd is within the specified range (Yes in step S106), it is not necessary to shift the work roll 12 in the axial direction. Thus, the axial position of the work roll 12 is not changed, and the process returns to step S102 to continuously detect the edge drop amount.

If the edge drop deviation ΔEd is out of the specified range in step S106 (No in step S106), the shift amount of the work roll 12 is decided such that the edge drop deviation ΔEd falls within the specified range (steps S108 to S112).

If the edge drop deviation ΔEd is out of the specified range in step S106 (No in step S106), and the edge drop deviation ΔEd is larger than the specified range (Yes in step S108; see the curve 106 in FIG. 6), the work roll 12 is shifted outward to decrease the gap between the rolls at the tapered portion 14 (step S110) so that the edge drop deviation ΔEd is brought closer to the specified range. Thus, the edge drop can be appropriately controlled.

In FIG. 6, the curve 106 indicates an example of the surface shape of the metal plate 50 when the edge up amount is relatively large. In this example, the position coordinate of the surface of the metal plate 50 at the measurement position $P_{Ed}$ is $H_1$. In this case, the edge drop deviation ΔEd is represented by $(H_1\text{-}H_A)$, and when $(H_1\text{-}H_A)$ is larger than the specified range, the work roll 12 is shifted outward in step S110 as described above.

In contrast, if the edge drop deviation ΔEd is out of the specified range in step S106 (No in step S106), and the edge drop deviation ΔEd is smaller than the specified range (No in step S108; see the curve 107 in FIG. 6), the work roll 12 is shifted inward to increase the gap between the rolls at the tapered portion 14 (step S112) so that the edge drop deviation ΔEd is brought closer to the specified range. Thus, by increasing the plate thickness at the plate edge portion, the edge drop can be controlled.

In FIG. 6, the curve 107 indicates an example of the surface shape of the metal plate 50 when the edge drop amount is relatively large. In this example, the position coordinate of the surface of the metal plate 50 at the measurement position $P_{Ed}$ is $H_2$. In this case, the edge drop deviation ΔEd is represented by $(H_2\text{-}H_A)$, and when $(H_2\text{-}H_A)$ is smaller than the specified range, the work roll 12 is shifted inward in step S110 as described above.

Here, a limit value (upper limit value) is set for the inward shift amount of the work roll 12 in step S112. In other words, in step S112, the work roll 12 is shifted inward to the extent that the shift amount of the work roll 12 does not exceed the limit value. This limit value is set to prevent the plate breakage due to edge tight. The limit value may be set based on experience.

In an embodiment, the heating position of the tapered portion 14 by the heating unit 30 is controlled by the heating control unit 92 according to the flowchart shown in FIG. 8. First, the plate edge position ($P_0$ position in FIG. 6) of the metal plate 50 in the axial direction of the work roll 12 (i.e., the plate width direction) is detected by the plate edge detection unit 40 (step S202).

Then, the deviation ΔWd between the position of the heating unit 30 in the axial direction (in an embodiment, the central position of the heating unit 30; $P_H$ position in FIG. 6) and the plate edge position detected in step S202 is calculated (step S204).

If the deviation ΔWd of the axial position calculated in step S204 is smaller than a specified range (No in step S206), it is determined that the heating position of the tapered portion 14 by the heating unit 30 is within an appropriate range, the process returns to step S202 to continuously detect the plate edge position. Conversely, if the deviation ΔWd of the axial position calculated in step S204 is larger than the specified range (Yes in step S206), the heating position of the tapered portion 14 by the heating unit 30 is decided such that the deviation ΔWd is within the specified range, and the heating unit 30 is moved along the axial direction to heat the decided heating position (step S208).

The specified range of the deviation ΔWd of the position in the plate width direction is set such that the heating position of the tapered portion 14 by the heating unit 30 is within the axial position range where the edge up of the metal plate 50 can occur in the rolling mill 1. The deviation ΔWd may be set based on the measurement position $P_{Ed}$ of the edge drop amount of the metal plate 50 described above.

By adjusting the heating position of the tapered portion 14 by the heating unit 30 in this way, the expansion portion 15 can be formed at an appropriate position of the tapered portion 14, and the edge tight which may occur in the metal plate 50 can be suppressed. As a result, the plate breakage at the edge portion of the metal plate 50 due to the edge tight can be reduced, so that the shift amount of the work roll 12 can be increased. For example, the limit value (upper limit value) of the inward shift amount of the work roll 12 in step S112 in the flowchart of FIG. 7 can be set larger. Thus, the shift amount of the work roll 12 can be increased to appropriately control the edge drop (edge drop amount and edge up amount) of the metal plate 50. Consequently, the edge drop which may occur in rolling of the metal plate 50 can be effectively reduced, and the yield can be improved.

Hereinafter, the overview of the rolling mill and the rolling method for a metal plate according to some embodiments will be described.

(1) A rolling mill according to at least one embodiment of the present invention comprises: a roll (e.g., the above-described work roll 12) for rolling a metal plate, the roll being capable of shifting in the axial direction and having a tapered portion at an end portion in the axial direction; and a heating unit configured to form an expansion portion protruding in the radial direction in the tapered portion by heating the tapered portion.

According to the above configuration (1), since the expansion portion protruding in the radial direction is formed in the tapered portion disposed at the end portion of the roll by the heating unit, edge tight at an edge portion of the metal plate (rolled material) in the plate width direction can be suppressed. As a result, the plate breakage at the edge portion of the metal plate due to the edge tight can be reduced, so that the shift amount of the roll can be increased. Consequently, the edge drop which may occur in rolling of the metal plate can be effectively reduced, and the yield can be improved.

(2) In some embodiments, in the above configuration (1), the heating unit is configured to heat the tapered portion by at least one of an electromagnetic induction coil, a heating medium, or a laser beam.

According to the above configuration (2), since the tapered portion can be heated by an electromagnetic induction coil, a heating medium, or a laser beam, it is easy to locally heat the tapered portion. Thus, the position and range forming the expansion portion in the tapered portion can be accurately adjusted, so that the edge tight can be effectively suppressed. Consequently, the shift amount of the roll can be increased, and the edge drop which may occur in rolling of the metal plate can be more effectively reduced.

(3) In some embodiments, in the above configuration (1) or (2), the heating unit includes an electromagnetic induction coil, and an electromagnetic shield for limiting a magnetic path through which a magnetic flux generated by the electromagnetic induction coil flows.

According to the above configuration (3), since the electromagnetic shield is configured to limit a magnetic path through which a magnetic flux generated by the electromagnetic induction coil flows, it is easy to limit the heating range of the tapered portion by the electromagnetic induction coil. Thus, the position and range forming the expansion portion in the tapered portion can be more accurately adjusted, so that the edge tight can be more effectively suppressed. Consequently, the shift amount of the roll can be increased, and the edge drop which may occur in rolling of the metal plate can be more effectively reduced.

(4) In some embodiments, in any one of the above configurations (1) to (3), the heating unit is configured to form the expansion portion inward in the plate width direction from the edge of the metal plate in the plate width direction.

According to the above configuration (4), since the expansion portion is formed, in the tapered portion, inward of the position of the edge (plate edge position) of the metal plate in the plate width direction, the edge tight which is likely to occur inward of the plate edge can be effectively suppressed. Consequently, the shift amount of the roll can be increased, and the edge drop which may occur in rolling of the metal plate can be more effectively reduced.

(5) In some embodiments, in any one of the above configurations (1) to (4), the rolling mill comprises a heating control unit configured to be able to change the heating position of the tapered portion by the heating unit in the axial direction by moving the heating unit along the axial direction.

According to the above configuration (5), since the heating position of the tapered portion by the heating unit can be changed in the axial direction of the roll, by adjusting the heating position appropriately, the edge tight can be effectively suppressed. Consequently, the shift amount of the roll can be increased, and the edge drop which may occur in rolling of the metal plate can be more effectively reduced.

(6) In some embodiments, in any one of the above configurations (1) to (5), the rolling mill comprises: a plate edge detection unit configured to detect the plate edge position of the metal plate in the plate width direction; and a heating control unit configured to decide the heating position of the tapered portion in the axial direction by the heating unit, on the basis of the detected plate edge position.

According to the above configuration (6), since the heating position of the tapered portion in the axial direction of the roll is decided on the basis of the plate edge position of the metal plate, even when the plate edge position of the metal plate changes, the heating position can be adjusted according to the plate edge position, and the edge tight can be effectively suppressed. Consequently, the shift amount of the roll can be increased, and the edge drop which may occur in rolling of the metal plate can be more effectively reduced.

(7) In some embodiments, in the above configuration (6), the plate edge detection unit is disposed on the entry side of the roll in the traveling direction of the metal plate.

According to the above configuration (7), since the plate edge position is detected on the entry side of the roll, by feed-forwarding the plate edge position, the heating position by the heating unit can be appropriately controlled. Thus, the edge tight can be effectively suppressed. Consequently, the shift amount of the roll can be increased, and the edge drop which may occur in rolling of the metal plate can be more effectively reduced.

(8) In some embodiments, in the above configuration (6), the plate edge detection unit is disposed on the exit side of the roll in the traveling direction of the metal plate.

According to the above configuration (8), since the plate edge position is detected on the exit side of the roll, by feed-backing the plate edge position, the heating position by the heating unit can be appropriately controlled. Thus, the edge tight can be effectively suppressed. Consequently, the shift amount of the roll can be increased, and the edge drop which may occur in rolling of the metal plate can be more effectively reduced.

(9) In some embodiments, in any one of the above configurations (6) to (8), the rolling mill comprises a plurality of rolling stands each of which includes a roll for rolling the metal plate. The heating unit is disposed on at least one of the plurality of rolling stands, and the plate edge detection unit is disposed between two rolling stands which are adjacent to each other in the traveling direction of the metal plate among the plurality of rolling stands.

According to the above configuration (9), since the plate edge position is detected between the rolling stands, by feed-backing or feed-forwarding the plate edge position, the heating position by the heating unit can be appropriately controlled. Further, as compared with the case of detecting the plate edge position on the entry side or the exit side of the plurality of rolling stands, the plate edge detection position can be easily brought closer to the heating position, so that the responsiveness of control of the heating position can be easily improved. Thus, the edge tight can be effectively suppressed. Consequently, the shift amount of the roll can be increased, and the edge drop which may occur in rolling of the metal plate can be more effectively reduced.

(10) In some embodiments, in any one of the above configurations (1) to (9), the rolling mill comprises: a plate thickness detection unit configured to detect a parameter related to the thickness of an edge portion of the metal plate in the plate width direction; and a roll control unit configured to decide the shift amount of the roll in the axial direction, on the basis of the detected parameter.

According to the above configuration (10), by suppressing the edge tight of the metal plate with the configuration (1), the plate breakage at the edge portion of the metal plate can be reduced, so that the shift amount of the roll can be decided to a larger value. Consequently, by increasing the shift amount of the roll, the edge drop which may occur in rolling of the metal plate can be effectively reduced, and the yield can be improved.

(11) A rolling method for a metal plate according to at least one embodiment of the present invention comprises: a step of rolling a metal plate with a roll having a tapered portion at an end portion in the axial direction; a step of shifting the roll in the axial direction; and a step of forming an expansion portion protruding in the radial direction in the tapered portion by heating the tapered portion.

According to the above method (11), since the expansion portion protruding in the radial direction is formed in the tapered portion disposed at the end portion of the roll by heating the tapered portion, edge tight at an edge portion of the metal plate (rolled material) in the plate width direction can be suppressed. As a result, the plate breakage at the edge portion of the metal plate due to the edge tight can be reduced, so that the shift amount of the roll can be increased. Consequently, the edge drop which may occur in rolling of the metal plate can be effectively reduced, and the yield can be improved.

(12) In some embodiments, in the above method (11), the step of forming the expansion portion includes forming the extension portion inward in the plate width direction from the edge of the metal plate in the plate width direction.

According to the above method (12), since the expansion portion is formed, in the tapered portion, inward of the position of the edge (plate edge position) of the metal plate in the plate width direction, the edge tight which is likely to occur inward of the plate edge can be effectively suppressed. Consequently, the shift amount of the roll can be increased, and the edge drop which may occur in rolling of the metal plate can be more effectively reduced.

(13) In some embodiments, in the above method (11) or (12), the rolling method comprises: a step of detecting the plate edge position of the metal plate in the plate width direction; and a step of deciding the heating position of the tapered portion in the axial direction, on the basis of the detected plate edge position.

According to the above method (13), since the heating position of the tapered portion in the axial direction of the roll is decided on the basis of the plate edge position of the metal plate, even when the plate edge position of the metal plate changes, the heating position can be adjusted according to the plate edge position, and the edge tight can be effectively suppressed. Consequently, the shift amount of the roll can be increased, and the edge drop which may occur in rolling of the metal plate can be more effectively reduced.

(14) In some embodiments, in any one of the above methods (11) to (13), the rolling mill comprises a step of changing the heating position by moving a heating unit for heating the tapered portion along the axial direction.

According to the above method (14), since the heating position of the tapered portion by the heating unit can be changed in the axial direction of the roll, by adjusting the heating position appropriately, the edge tight can be effectively suppressed. Consequently, the shift amount of the roll can be increased, and the edge drop which may occur in rolling of the metal plate can be more effectively reduced.

(15) In some embodiments, in any one of the above methods (11) to (14), the rolling method comprises: a step of detecting a parameter related to the thickness of an edge portion of the metal plate in the plate width direction; and a step of deciding the shift amount of the roll in the axial direction, on the basis of the detected parameter.

According to the above method (15), by suppressing the edge tight of the metal plate with the method (11), the plate breakage at the edge portion of the metal plate can be reduced, so that the shift amount of the roll can be decided to a larger value. Consequently, by increasing the shift amount of the roll, the edge drop which may occur in rolling of the metal plate can be effectively reduced, and the yield can be improved.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", and "have" are not intended to be exclusive of other components.

REFERENCE SIGNS LIST

1 Rolling mill
10, 10A to 10*d* Rolling stand
12, 12A, 12B Work roll
13 End portion
14 Tapered portion
15 Expansion portion
16*a*, 16*b* Bearing box
18A, 18B Intermediate roll
20*a*, 20*b* Bearing box
22A, 22B Backup roll
24*a*, 24*b* Bearing box
26, 26A, 26B Roll driving unit
30 Heating unit
32 Electromagnetic induction coil
34 Electromagnetic shield
40 Plate edge detection unit
42 Edge drop meter
44 Edge drop meter
46 Edge position meter
48 Plate thickness detection unit
50 Metal plate
52 Surface
54 Plate edge
90 Control device
92 Heating control unit
94 Roll control unit

The invention claimed is:

1. A rolling mill, comprising:

a roll for rolling a metal plate, the roll being capable of shifting in an axial direction and having a tapered portion at an end portion in the axial direction; and a heating unit configured to heat a part of the tapered portion in the axial direction to form an expansion portion protruding in a radial direction in the part of the tapered portion with respect to the other part of the tapered portion, wherein the heating unit includes an electromagnetic induction coil, and electromagnetic shields on both sides of the electromagnetic induction coil in the axial direction of the roll for limiting a magnetic path in the axial direction through which a magnetic flux generated by the electromagnetic induction coil flows, wherein the rolling mill further comprises:

an edge drop meter configured to detect an edge drop amount; and a roll control unit configured to shift the roll in the axial direction on the basis of the edge drop amount detected by the edge drop meter, and wherein the edge drop amount is a difference between the plate thickness at a specified position in a central portion of the metal plate in the axial direction and the plate thickness at a measurement position away from a plate edge of the metal plate by a specified distance inward in the axial direction.

2. The rolling mill according to claim 1, wherein the heating unit is configured to heat the tapered portion by at least one of an electromagnetic induction coil, a heating medium, or a laser beam.

3. The rolling mill according to claim 1, comprising a heating control unit configured to be able to change a heating position of the tapered portion by the heating unit in the axial direction by moving the heating unit along the axial direction.

4. The rolling mill according to claim 1, comprising:

a plate edge detection unit configured to detect a plate edge position of the metal plate in a plate width direction; and a heating control unit configured to decide a heating position of the tapered portion in the axial direction by the heating unit, on the basis of the detected plate edge position.

5. The rolling mill according to claim 4, wherein the plate edge detection unit is disposed on an entry side of the roll in a traveling direction of the metal plate.

6. The rolling mill according to claim 4, wherein the plate edge detection unit is disposed on an exit side of the roll in a traveling direction of the metal plate.

7. The rolling mill according to claim 4, comprising a plurality of rolling stands each of which includes a roll for rolling the metal plate, wherein the heating unit is disposed on at least one of the plurality of rolling stands, and wherein the plate edge detection unit is disposed between two rolling stands which are adjacent to each other in a traveling direction of the metal plate among the plurality of rolling stands.

8. The rolling mill according to claim 1, comprising:

a plate thickness detection unit configured to detect a parameter related to thickness of an edge portion of the metal plate in a plate width direction; and a roll control unit configured to decide a shift amount of the roll in the axial direction, on the basis of the detected parameter.

9. The rolling mill according to claim 1, wherein the roll control unit is configured to decide, on the basis of the edge drop amount, whether the roll is to be shifted outward or inward in the axial direction.

10. A rolling method for a metal plate in which a metal plate is rolled with a roll having a tapered portion at an end portion in an axial direction, and the roll is shifted in the axial direction, the rolling method comprising:

a step of heating a part of the tapered portion in the axial direction to form an expansion portion protruding in a radial direction in the part of the tapered portion with respect to the other part of the tapered portion, wherein the heating step includes a step of heating the part of the tapered portion by a heating unit including an electromagnetic induction coil, and electromagnetic shields on both sides of the electromagnetic induction coil in the axial direction of the roll for limiting a magnetic path in the axial direction through which a magnetic flux generated by the electromagnetic induction coil flows, wherein the rolling mill further comprises:

an edge drop meter configured to detect an edge drop amount; and a roll control unit configured to shift the roll in the axial direction on the basis of the edge drop amount detected by the edge drop meter, and wherein the edge drop amount is a difference between the plate thickness at a specified position in a central portion of the metal plate in the axial direction and the plate thickness at a measurement position away from a plate edge of the metal plate by a specified distance inward in the axial direction.

11. The rolling method for a metal plate according to claim 10, wherein the step of forming the expansion portion includes forming the extension portion inward in a plate width direction from an edge of the metal plate in the plate width direction.

12. The rolling method for a metal plate according to claim 10, comprising:

a step of detecting a plate edge position of the metal plate in a plate width direction; and a step of deciding a heating position of the tapered portion in the axial direction, on the basis of the detected plate edge position.

13. The rolling method for a metal plate according to claim 10, comprising a step of changing the heating position by moving the heating unit along the axial direction.

14. The rolling method for a metal plate according to claim 10, comprising:

a step of detecting a parameter related to thickness of an edge portion of the metal plate in a plate width direction; and a step of deciding a shift amount of the roll in the axial direction, on the basis of the detected parameter.

* * * * *